US006659416B2

(12) United States Patent
Hicks et al.

(10) Patent No.: US 6,659,416 B2
(45) Date of Patent: Dec. 9, 2003

(54) COMPUTER KEYBOARD/MOUSE SUPPORT APPARATUS

(75) Inventors: Jack C. Hicks, Westminster, CO (US); Randy W. Woods, Wheatridge, CO (US)

(73) Assignee: Ergonomic Design Inc, Northglenn, CO (US)

( * ) Notice: Subject to any disclaimer, the term of this patent is extended or adjusted under 35 U.S.C. 154(b) by 0 days.

(21) Appl. No.: 10/072,530

(22) Filed: Feb. 5, 2002

(65) Prior Publication Data

US 2002/0104948 A1 Aug. 8, 2002

Related U.S. Application Data

(60) Provisional application No. 60/266,688, filed on Feb. 7, 2001.

(51) Int. Cl.[7] ..... A47B 91/00; A47G 29/00

(52) U.S. Cl. ..... 248/346.11; 249/918; 249/118; 249/118.1; 249/920; 249/299.1; 312/308.1; 108/103; 108/139; 108/50.02

(58) Field of Search ..... 248/918, 346.11, 248/299.1, 118, 118.1, 118.5, 920, 921, 919, 289.1; 312/205.1, 223.3; 108/50.02, 50.01, 94, 103, 139

(56) References Cited

U.S. PATENT DOCUMENTS

| | | | | | |
|---|---|---|---|---|---|
| 573,960 | A | * | 12/1896 | Bruss | 108/26 |
| 2,468,473 | A | * | 4/1949 | Underwood | 312/194 |
| 4,955,571 | A | * | 9/1990 | Lorence et al. | 248/311.2 |
| 4,974,808 | A | * | 12/1990 | Ball | 248/639 |
| 5,522,572 | A | * | 6/1996 | Copeland et al. | 248/118 |
| 5,667,320 | A | * | 9/1997 | Ambrose et al. | 400/472 |
| 5,732,910 | A | | 3/1998 | Martin | |
| 5,771,814 | A | * | 6/1998 | Clausen | 108/93 |
| 5,775,657 | A | * | 7/1998 | Hung | 248/289.11 |
| 5,832,840 | A | * | 11/1998 | Woof | 108/6 |
| 5,901,934 | A | * | 5/1999 | Wilson | 248/346.01 |
| D410,453 | S | | 6/1999 | Timm | |
| 5,915,655 | A | | 6/1999 | Gutowski | |
| 6,045,098 | A | | 4/2000 | Timm | |
| 6,119,603 | A | | 9/2000 | Lochridge | |
| 6,247,672 | B1 | | 6/2001 | Bello | |
| 6,296,215 | B1 | * | 10/2001 | McCoy et al. | 248/284.1 |
| 6,505,566 | B1 | * | 1/2003 | Foster et al. | 108/138 |

OTHER PUBLICATIONS

Ergonomic Design, Inc. EDI Brochure pp. 5, 7 & 8.

* cited by examiner

*Primary Examiner*—Kimberly Wood
(74) *Attorney, Agent, or Firm*—Brian D. Smith, P.C.

(57) ABSTRACT

A computer keyboard/mouse support apparatus including a keyboard support having three layers which are rigidly sandwiched together is disclosed. The top layer is for supporting a keyboard while the bottom layer is for attachment to a keyboard arm. The center layer has a surface area which is substantially less than that of the top and bottom layers so that it defines a gap in which left and right mouse extensions pivot between extended usable positions and retracted stored positions. In their extended usable positions, the front edges of the keyboard support and the mouse extensions are flush with each other and define an ergonomic curve. The top surface of each mouse extension also preferably frictionally engages the underside surface of the keyboard support so that the extensions are not easily moved by the user when moving a mouse supported on the surface of the extension.

37 Claims, 4 Drawing Sheets

COMPUTER KEYBOARD/MOUSE SUPPORT APPARATUS

CROSS REFERENCE TO RELATED APPLICATIONS

This application is a nonprovisional application claiming the benefit under 35 USC 119(e) of U.S. provisional application Ser. No, 60/266,688, filed on Feb. 7, 2001.

FIELD OF THE INVENTION

The present invention concerns a computer keyboard support having at least one movable extension for supporting a data input device, such as a mouse, which allows the user to control a cursor position on a computer viewing screen or monitor.

BACKGROUND ART

The personal computer revolution has resulted in the use of personal computers and computer terminals on corporate and home desktops throughout the world. Almost all such computers and terminals allow data entry through an alphanumeric keyboard. Often the keyboard rests on a desktop surface which is at the same level as the surface that supports the viewing monitor. While such an arrangement may be fine for users who only spend a short period of time at the computer, for users who spend long periods of time at the computer, it is important to be able to adjust the position and/or orientation of the keyboard. Built in tabs that form an integral part of the keyboard allow for some adjustment. However, to allow more flexibility in positioning the keyboard, e.g. to suit a user's ergonomic requirements, it is desirable to provide the keyboard with its own support. It is also desirable to provide the mouse with its own support for the same reason.

One such keyboard/mouse support sold by the assignee of the present invention Ergonomic Design Inc. of Denver, Colo. is moveably supported by a keyboard arm that allows the keyboard to be moved out from under a user's desk and then stored beneath the desk when the keyboard is not in use. This keyboard support also has a pair of pivoting right and left mouse extensions that pivot out from underneath the keyboard support to the right and left of the keyboard. While this design works well, the surface of the mouse extension is at a level which is somewhat lower than the surface of the keyboard support. It would be desirable if the surfaces of the mouse extension and the keyboard support were at the same level or as close as possible to the same level. It would also be desirable if this apparatus had a more ergonomic shape that followed the movement of a user's arm as it moves between the keyboard support and the mouse extension. It would further be desirable if the keyboard support were easy to attach to a keyboard arm.

SUMMARY OF THE INVENTION

The present invention addresses that foregoing needs by providing a computer keyboard/mouse apparatus that includes a keyboard support and at least one mouse extension pivotally attached to the keyboard support. The keyboard support is of the type for attachment to a keyboard arm and has a top surface for supporting a keyboard and a generally planar underside surface. The mouse extension has a top surface for supporting a mouse and is pivotally attached to the keyboard support so that it pivots in a plane parallel to the plane of the keyboard support. The mouse extension pivots between an extended usable position in which a substantial portion of the mouse extension is exposed and capable of being used as a mouse extension and a retracted stored position in which a substantial portion of the top surface of the mouse extension is facing the underside surface of said keyboard support. The top surface of the mouse extension is also in close proximity to the underside surface of the keyboard support so that the distance between the surface is minimized. Preferably the surfaces are in actual contact with each other so that a pre-determined amount of force is required to pivot the extension and so that the extension is not easily moved by the user when moving a mouse on the top surface of the mouse extension. The mouse extension is also characterized by being capable of pivoting 360 degrees without contacting the keyboard arm when (1) the keyboard support is attached to the keyboard arm and (2) there is no other structure of the keyboard support or the mouse extension preventing such pivoting.

In a preferred embodiment, the keyboard support includes three layers which are rigidly sandwiched together. The top layer is for supporting a keyboard while the bottom layer is for attachment to a keyboard arm, typically a retractable keyboard arm. The center layer has a surface area which is substantially less than that of the top and bottom layers so that it defines a gap between the top and bottom layers. The mouse extension is pivotally attached to the keyboard support between said top and bottom layers for pivoting between its extended usable position and its retracted stored position. In its retracted stored position a substantial portion of the mouse extension is received within the gap between the top and bottom layers.

Another preferred A computer keyboard/mouse apparatus of the present invention provides a keyboard support having a generally rectangular shape so as to define a front edge, a rear edge and right and left side edges. In addition, a pair of right and left (or first and second) mouse extensions are provided that are pivotally attached to the keyboard support. As with the other embodiments of the present invention, each mouse extensions pivots between an extended usable position in which a substantial portion of the mouse extension is exposed and capable of being used as a mouse extension and a retracted stored position. Each mouse extension also has a front edge and the first or right mouse extension is pivotally attached to the keyboard support so that when it is pivoted to its extended usable position a substantial portion of it is located to the right of the right side edge of the keyboard support. Similarly, the second or left mouse extension is pivotally attached to the keyboard support so that when it is pivoted to its extended usable position a substantial portion of it is located to the left of the left side edge of the keyboard support. In addition and importantly, when the mouse extensions are in their extended usable positions the front edges thereof and the front edge of the keyboard support are flush with each other. In a most preferred embodiment, these flush edges define a curved edge having a predetermined radius of curvature. This predetermined curvature provides the apparatus with a more ergonomic shape that follows the movement of a user's arm between the keyboard support and the mouse extension.

The present invention also provides a novel keyboard support having a top layer and a bottom layer separated by a gap and an extremely easy method of attaching this keyboard support to a keyboard arm. The novel keyboard support has a top layer for supporting a keyboard and a bottom layer for attachment to a keyboard arm. The layers are separated by a gap and define at least one pair of axially aligned holes with the axis of said holes passing through the gap. The axially aligned hole of the top layer has a diameter which is large enough to pass the head of a given threaded fastener for securing the bottom layer to a keyboard arm and the axially aligned hole of the bottom layer has a diameter which is large enough to pass the shank but not the head of the said given threaded fastener.

The novel keyboard support is easily attached to a keyboard arm by simply inserting the given threaded fastener through the axially aligned hole in the top layer and into the axially aligned hole of the bottom layer so that it is in position to secure the keyboard support to the keyboard arm. The now positioned fastener is then threaded into the keyboard arm to secure the keyboard support to the keyboard arm.

Those skilled in the art will appreciate that the provision of the above described axially aligned holes in the top and bottom layers of the keyboard support makes it extremely easy for a user to attach the keyboard support to a keyboard arm since it enables the user to attach the apparatus to the retractable arm after it has been completely assembled. Therefore, the user does not have to assemble the keyboard. This can and normally would be done by the manufacturer.

These and other objects, advantages, and features of the exemplary embodiment of the invention are described in detail in conjunction with the accompanying drawings.

DETAILED DESCRIPTION OF A PREFERRED EMBODIMENT

Figure 1:
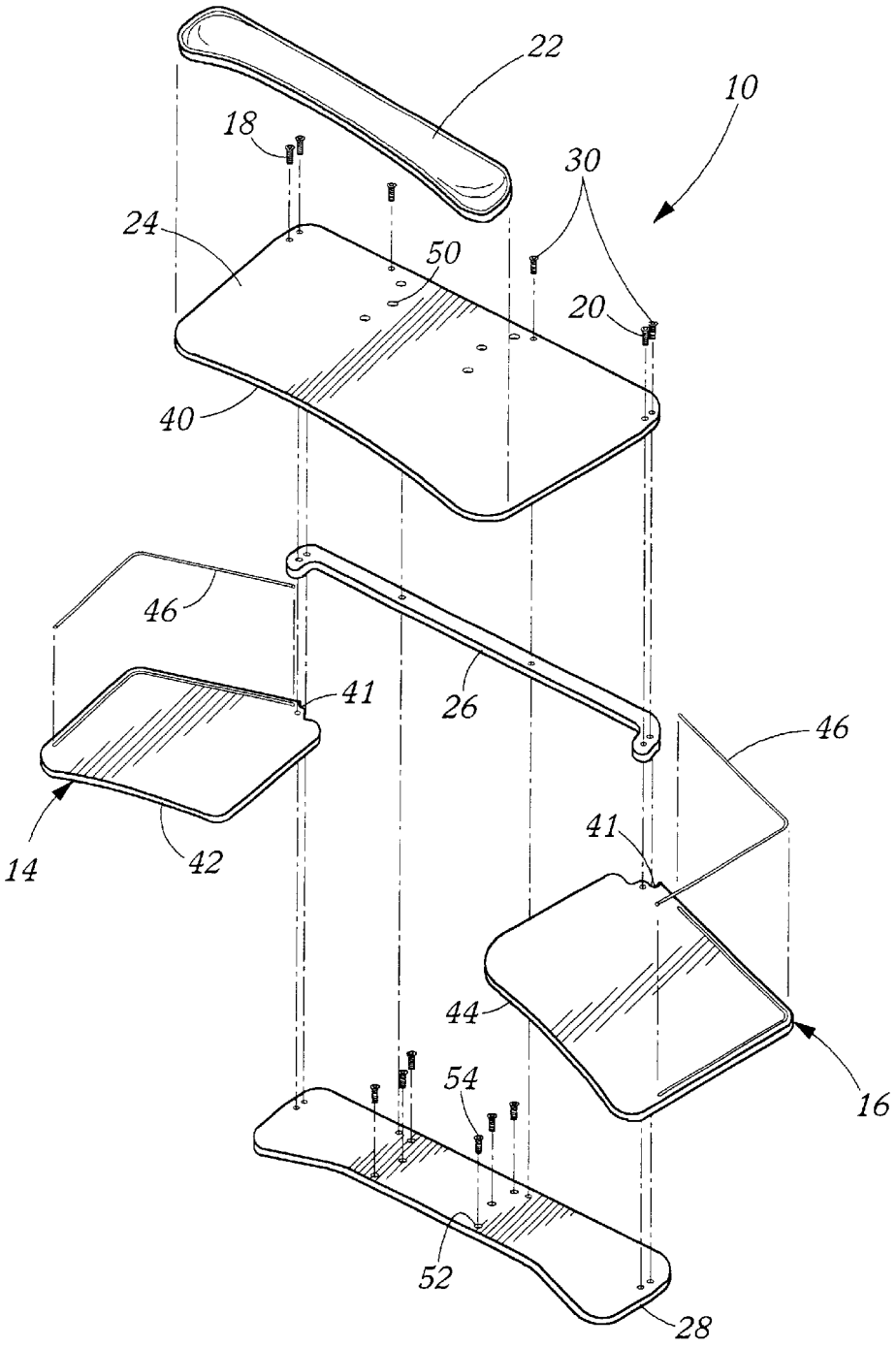
FIG. 1 is an exploded perspective view of a computer keyboard/mouse apparatus of the present invention that includes a keyboard support and a pair of left and right mouse extensions.

As shown in drawings, computer keyboard/mouse apparatus 10 of the present invention generally includes a keyboard support 12 for supporting a computer keyboard (not shown) and a pair of left and right mouse extensions 14, 16 for supporting a computer mouse (not shown). The mouse extensions 14, 16 are pivotally attached to the keyboard support by pins 18, 20. The keyboard support is also provided with a conventional wrist support 22. The keyboard support 12 is mounted to a retractable arm (shown in dotted line at 23) that typically extends out from beneath a workstation (not shown) and allows the user to adjustably position apparatus 10 relative to the workstation.

Figure 2:
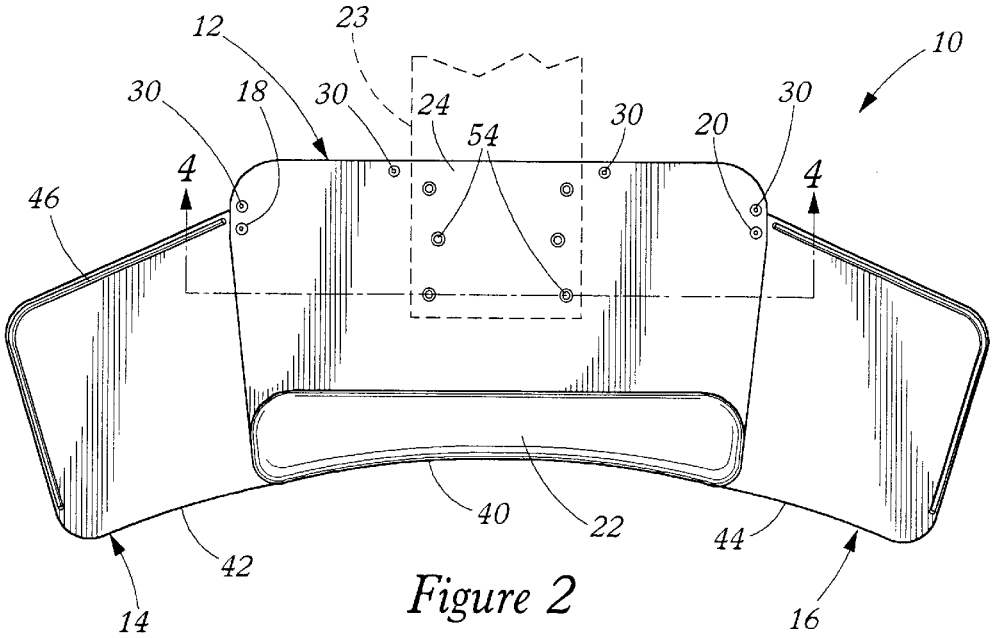
FIG. 2 is a top plan view of the workstation apparatus of FIG. 1 showing the left and right mouse extensions thereof in their extended usable positions.
Figure 3:
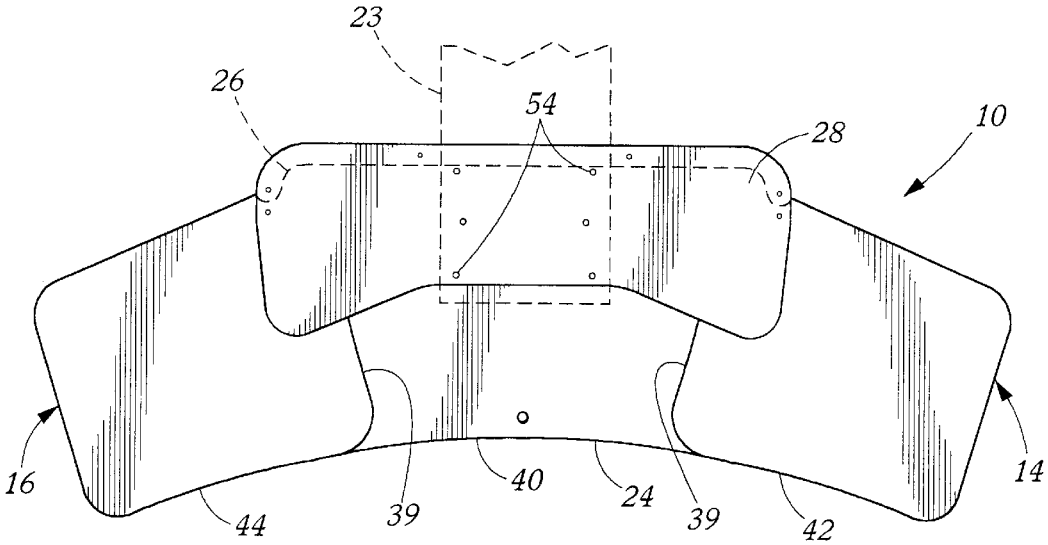
FIG. 3 is a bottom plan view of the workstation apparatus of FIG. 1 showing the left and right mouse extensions thereof in their extended usable positions as also shown in FIG. 2.
Figure 3A:
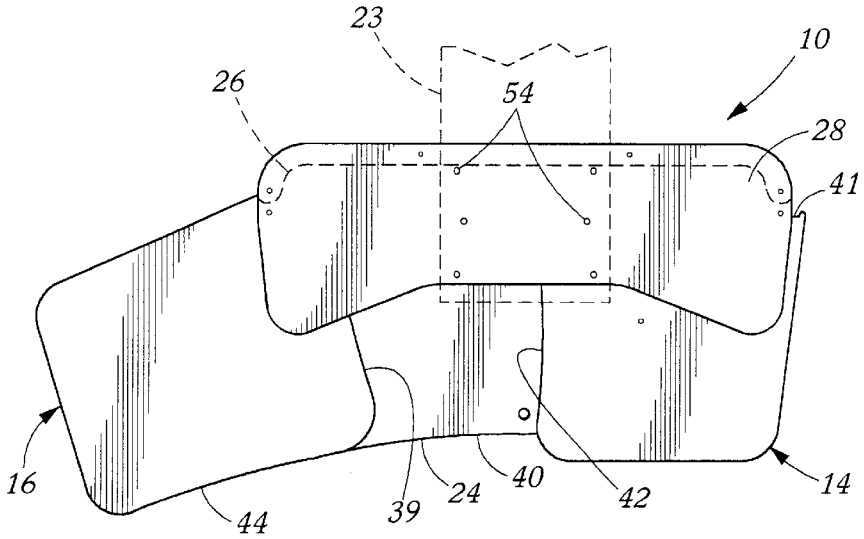
FIG. 3A is a top plan view similar to that of FIG. 3 differing, however, in that the left mouse extension is shown in its retracted stored position as also shown in FIG. 2A.
Figure 4:
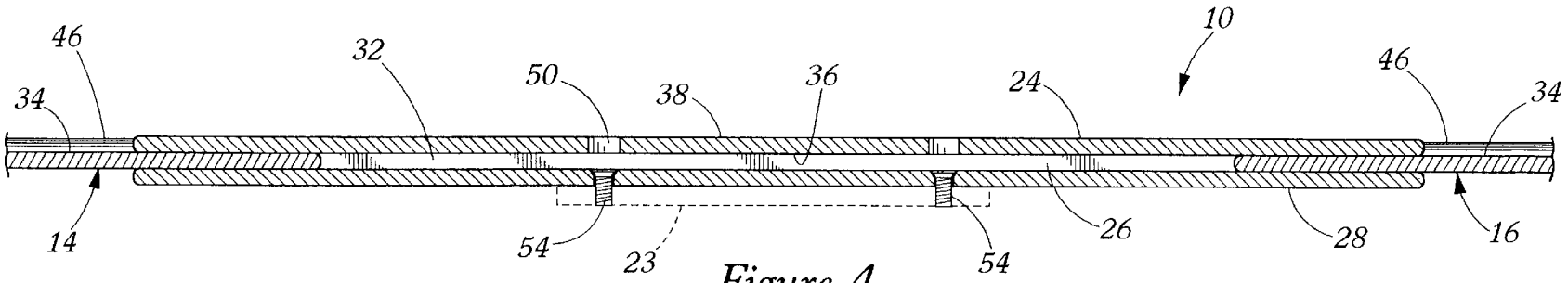
FIG. 4 is a cross-sectional view taken along lines 4—4 of FIG. 2.

As shown in FIGS. 1 and 4, keyboard support 12 preferably comprises three layers 24, 26 and 28 of material, preferably high pressure phenolic laminate, which are rigidly sandwiched together by fasteners 30. The top layer 24 is for supporting a keyboard (not shown) while the bottom layer 28 is for attachment to the retractable keyboard arm 23. The center layer 26 has a surface area which is substantially less than that of the top and bottom layers so that it defines a gap 32 between the top and bottom layers. The left and right mouse extensions 14, 16 are pivotally attached to the keyboard support by the aforementioned pins 18, 20 between the top and bottom layers for enabling the mouse extensions to pivot between their extended usable positions shown in FIGS. 2–4 and their retracted stored positions. Left mouse extension 14 is shown in its retracted position in FIGS. 2A, 3A and 4A. As will be appreciated, when a mouse extension is in its retracted stored position a substantial portion of it is received in gap 32 between the top and bottom layers as shown by extension 14 in FIG. 4A.

Figure 4A:
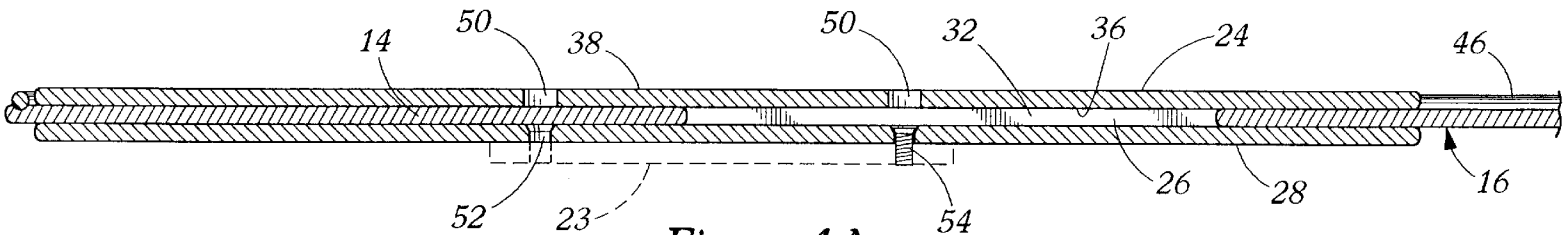
FIG. 4A is a cross-sectional view taken along lines 4A—4A of FIG. 2A with the exception that a screw 54 is not shown threaded into a hole 52 of the keyboard support.

In accordance with an important aspect of the present invention and as best shown in FIGS. 4 and 4A, the top surfaces 34 of the mouse extensions are in close proximity to the underside surface 36 of the keyboard support's top layer 24 so that the distance between the surfaces is minimized. Preferably the surfaces are in actual contact with, i.e. they frictionally engage, each other as shown in FIGS. 4 and 4A so that a pre-determined amount of force is required to pivot the extension. This amount is preset or pre-determined to prevent the extension from being easily moved by the user when moving a mouse on the top surface of the mouse extension. In addition, by keeping these surfaces in contact or as close as possible to each other, preferably within ⅛ of an inch of each other, the top surface 34 of the mouse extension is at a level which is close to the level of the working surface 38 of the top layer 24 of the keyboard support. This makes the apparatus more ergonomic since it means the user will not have to move his hand vertically very much when moving it between the keyboard and the mouse.

Figure 2A:
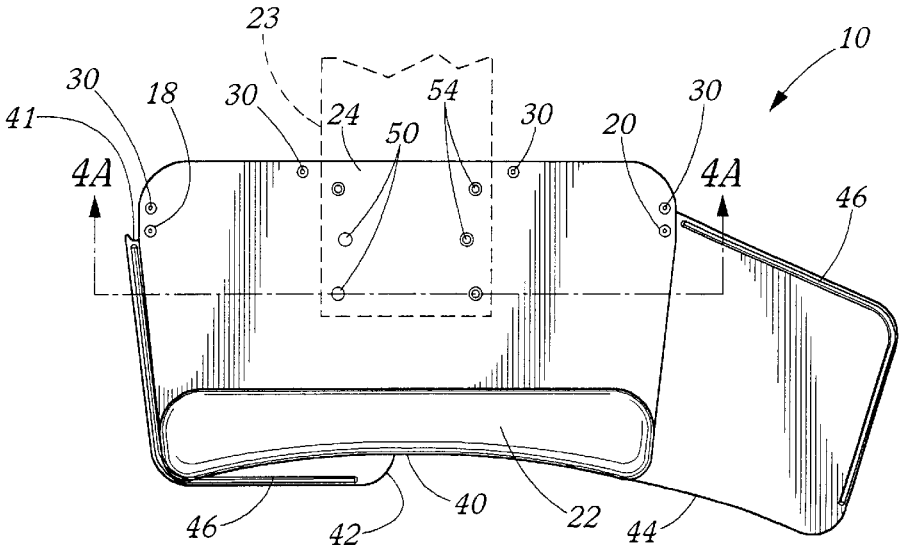
FIG. 2A is a top plan view similar to that of FIG. 2 differing, however, in that the left mouse extension is shown in its retracted stored position.

Those skilled in the art will appreciate that the three layered nature of the apparatus allows the keyboard support to be mounted to the retractable arm on the bottom surface of the support's bottom layer 28. The enables the mouse extensions to be located in the center layer, thereby positioning the working surfaces of the mouse extensions and the keyboard support as close as possible to each other. This is an important structural feature of the invention which is described in the claims appended hereto since it provides the mouse extensions with the theoretical capability of pivoting 360 degrees without contacting the keyboard arm when (1) the keyboard support is attached to the keyboard arm and (2) there is no other structure (such as center layer 26) of the keyboard support or the mouse extension preventing such pivoting. As indicated, such 360 degree pivoting is theoretically possible since the keyboard support is mounted to the keyboard arm on its bottom layer 28, thereby theoretically allowing the mouse extensions to freely pivot since they are positioned in the center layer and could indeed pivot 360 degrees if center layer 26 were removed. As will be appreciated, the center layer prevents further pivoting of the mouse extensions when they are pivoted to their retracted stored positions. FIGS. 3 and 3A illustrate that edges 39 of the mouse extensions contact the front edge of the center layer 26 when the mouse extensions are pivoted to their retracted stored positions, thereby preventing further inward movement of the extensions. Similarly, FIGS. 2A and 3A illustrate that each mouse extension is provided with a curved lip edge 41 which prevents outward movement of the mouse extensions when it is pivoted outwardly to its extended usable position. As will be appreciated, lip edge 41 contacts the outer edge of the center layer 26 to prevent such movement when the mouse extension is pivoted to its extended usable position.

Another important aspect of the present invention is directed to the design or shaping of the front edges 40, 42 and 44 of the keyboard support and left and right mouse extensions, respectively, which causes these edges to be flush with each when the mouse extensions are in their extended usable positions. In addition and as shown, these flush edges define a curved edge having a predetermined radius of curvature which as shown in the disclosed embodiment is about 36.625 degrees. This predetermined curvature provides the apparatus with a more ergonomic shape that follows the movement of a user's arm between the keyboard support and the mouse extension.

The sizing and shaping of the mouse extensions also enables a mouse bumper strip 46 to be positioned along the peripheral edge of each extension which as will be appreciated covers almost 180 degrees of each extension's peripheral edge. As shown, strip 46 clearly extends more than 125 degrees around each mouse extension's peripheral edge, thereby substantially enhancing the mouse extension's usability. As those skilled in the art will appreciate, a mouse extension which does not prevent the user from running the mouse off the edge of the extension is not very user friendly.

The present invention also provides an extremely easy method of attaching keyboard support 12 to the retractable keyboard arm 23. This is accomplished by simply providing as shown six pairs of differently sized but axially aligned holes 50, 52 in the top and bottom layers of the keyboard support with the axis of each pair of holes passing through the gap 32 of the keyboard support. The axially aligned hole 50 of the top layer is dimensioned so that it has a diameter which is large enough to pass the head of a given threaded fastener 54 for securing the bottom layer to the keyboard arm. The axially aligned hole 52 of the bottom layer has a diameter which is large enough to pass the shank but not the head of the given threaded fastener for securing said bottom layer to said keyboard arm.

With the axially aligned holes provided in the top and bottoms layers as described, the keyboard support is easily attached to the keyboard arm by simply:

1. Inserting a given threaded fastener 54 through each hole 50 of the top layer and into its corresponding axially aligned hole 52 of the bottom layer so that it is in position to secure the keyboard support to the keyboard arm and then;
2. Threading each now positioned screw or fastener 54 into the keyboard arm to secure the keyboard support to the keyboard arm as such is shown in FIG. 4. In FIG. 4A, the screw or fastener 54 has been removed from the left hole 52 to provide a better view of the hole and its corresponding axially aligned hole 50 located immediately above hole 52 in the top layer 24.

Those skilled in the art will appreciate that the provision of the above described axially aligned holes in the top and bottom layers of the keyboard support makes it extremely easy for a user to attach the keyboard support to a keyboard arm since it enables the user to attach the apparatus to the retractable arm after it has been completely assembled. Therefore, the user does not have to assemble the keyboard support. This can and normally would be done by the manufacturer.

While the present invention has been described with a degree of particularity, it is the intent that the invention include all modifications and alterations from the disclosed design falling with the spirit or scope of the appended claims.

We claim:

1. A computer keyboard/mouse apparatus comprising:

a) a keyboard support of the type for attachment to a keyboard arm, said keyboard support having a first top surface for supporting a keyboard and a generally planar underside underside surface; and, b) a first mouse extension having a second top surface for supporting a mouse, said first mouse extension being pivotally attached to said keyboard support for pivoting in a plane parallel to the plane of said keyboard support between an extended usable position in which a substantial portion of said first mouse extension is exposed and capable of being used as a mouse extension and a retracted stored position in which a substantial portion of said top surface of said first mouse extension is facing said underside surface of said keyboard support, wherein the distance between said second top surface of said first mouse extension and said underside surface of said keyboard support is equal to or less than about ⅛ of an inch such that the distance between said second top surface of said first mouse extension and said underside surface of said keyboard is minimized, said first mouse extension also being capable of pivoting 360 degrees without contacting the keyboard arm when said keyboard support is attached to the keyboard arm.

2. A computer keyboard/mouse apparatus as claimed in claim 1 wherein said keyboard support is generally rectangularly shaped so as to define a front edge, a rear edge and right and left side edges and wherein said first mouse extension is pivotally attached to said keyboard support at a point adjacent said right side and rear edges thereof so that when said first mouse extension is pivoted to its extended usable position a substantial portion of said first mouse extension is located to the right of said right side edge of said keyboard support.

3. A computer keyboard/mouse apparatus as claimed in claim 2 further comprising a second mouse extension which is pivotally attached to said keyboard support at a point adjacent said left side and rear edges thereof so that when said second mouse extension is pivoted to its extended usable position a substantial portion of said second mouse extension is located to the left of said left side edge of said keyboard support.

4. A computer keyboard/mouse apparatus as claimed in claim 1 wherein said second top surface of said mouse extension and said underside surface of said keyboard frictionally engage each other.

5. A computer keyboard/mouse apparatus as claimed in claim 4 wherein the frictional contact between said second top surface and said underside surface is controlled so that a pre-determined amount of force is required to pivot said first mouse extension.

6. A computer keyboard/mouse apparatus as claimed in claim 1 further comprising structure which stops further pivoting of said first mouse extension when said first mouse extension is pivoted to its extended usable position.

7. A computer keyboard/mouse apparatus as claimed in claim 1 further comprising structure which stops further pivoting of said first mouse extension when said first mouse extension is pivoted to its retracted stored position.

8. A computer keyboard/mouse apparatus as claimed in claim 1 further comprising a mouse bumper strip mounted in said second top surface of said first mouse.

9. A computer keyboard/mouse apparatus as claimed in claim 8 wherein said mouse bumper strip extends around more than 125 degrees of the extension's peripheral edge.

10. A computer keyboard/mouse apparatus as claimed in claim 1 wherein the front edge of said keyboard support and the front edge of said first mouse extension are flush with each other when said first mouse extension is in its extended position.

11. A computer keyboard/mouse apparatus as claimed in claim 10 wherein said flush front edges of said keyboard support and said first mouse extension define a curved edge having a predetermined radius of curvature.

12. A computer keyboard/mouse apparatus as claimed in claim 3 wherein the front edge of said keyboard support, the front edge of said first mouse extension and the front edge of said second mouse extension are flush with each other when said mouse extensions are in their extended positions.

13. A computer keyboard/mouse apparatus as claimed in claim 12 wherein said flush front edges of said keyboard support and said mouse extensions define a curved edge having a predetermined radius of curvature.

14. A computer keyboard/mouse apparatus comprising:

a) a keyboard support including a top layer for supporting a keyboard, a bottom layer for attachment to a keyboard arm, and a center layer having a surface area which is substantially less than that of said top and bottom layers so as to define a gap between said top and bottom layers, said layers also being rigidly sandwiched together; and b) a first mouse extension pivotally attached to said keyboard support between said top and bottom layers for pivoting between an extended usable position in which a substantial portion of said first mouse extension is exposed and capable of being used as a mouse extension and a retracted stored position in which a substantial portion of said first mouse extension is received within the gap between said top and bottom layers.

15. A computer keyboard/mouse apparatus as claimed in claim 14 wherein said keyboard support is generally rectangularly shaped so as to define a front edge, a rear edge and right and left side edges and wherein said first mouse extension is pivotally attached to said keyboard support at a point adjacent said right side and rear edges thereof so that when said first mouse extension is pivoted to its extended usable position a substantial portion of said first mouse extension is located to the right of said right side edge of said keyboard support.

16. A computer keyboard/mouse apparatus as claimed in claim 15 further comprising a second mouse extension which is pivotally attached to said keyboard support at a point adjacent said left side and rear edges thereof so that when said second mouse extension is pivoted to its extended usable position a substantial portion of said second mouse extension is located to the left of said left side edge of said keyboard support.

17. A computer keyboard/mouse apparatus as claimed in claim 14 wherein said top, bottom and center layers have rear edges which are generally flush with each other so as to define said rear edge of said keyboard support.

18. A computer keyboard/mouse apparatus as claimed in claim 14 wherein said top layer has a top surface for supporting a keyboard and a generally planar underside surface and said first mouse extension has a top surface, said top layer underside surface and first mouse top surface being in close proximity to each other.

19. A computer keyboard/mouse apparatus as claimed in claim 18 wherein said first mouse top surface and said top layer underside surface frictionally contact each other.

20. A computer keyboard/mouse apparatus as claimed in claim 19 wherein the frictional contact between said first mouse top surface and said top layer underside surface is controlled so that a pre-determined amount of force is required to pivot said first mouse extension.

21. A computer keyboard/mouse apparatus as claimed in claim 14 wherein said first mouse extension is provided with a lip shaped edge which impacts up against said center layer to prevent further pivoting of said first mouse extension when said first mouse extension is pivoted to its extended usable position.

22. A computer keyboard/mouse apparatus as claimed in claim 14 wherein said center layer prevents further pivoting of said first mouse extension when said first mouse extension is pivoted to its retracted stored position.

23. A computer keyboard/mouse apparatus as claimed in claim 14 further comprising a mouse bumper strip mounted in the top surface of said first mouse extension along the peripheral edge thereof.

24. A computer keyboard/mouse apparatus as claimed in claim 23 wherein said mouse bumper strip extends around more than 125 degrees of the extension's peripheral edge.

25. A computer keyboard/mouse apparatus as claimed in claim 14 wherein the front edge of said keyboard support and the front edge of said first mouse extension are flush with each other when said first mouse extension is in its extended position.

26. A computer keyboard/mouse apparatus as claimed in claim 25 wherein said flush front edges of said keyboard support and said first mouse extension define a curved edge having a predetermined radius of curvature.

27. A computer keyboard/mouse apparatus as claimed in claim 16 wherein the front edge of said keyboard support, the front edge of said first mouse extension and the front edge of said second mouse extension are flush with each other when said mouse extensions are in their extended positions.

28. A computer keyboard/mouse apparatus as claimed in claim 27 wherein said flush front edges of said keyboard support and said mouse extensions define a curved edge having a predetermined radius of curvature.

29. A computer keyboard/mouse apparatus as claimed in claim 14 wherein said top layer of said keyboard support is generally rectangular in plan.

30. A computer keyboard/mouse apparatus as claimed in claim 14 further comprising a wrist support mounted on said top surface of said top layer along the front edge thereof.

31. A computer keyboard/mouse apparatus as claimed in claim 14 wherein said bottom layer has a region for supporting said first mouse extension in its extended position.

32. A computer keyboard/mouse apparatus as claimed in claim 14 wherein at least one pair of axially aligned holes is provided in said top and bottom layers with the axis of said holes passing through the gap of said keyboard support defined by said center layer, said axially aligned hole provided in said top layer having a diameter which is large enough to pass the head of a threaded fastener for securing said bottom layer to said keyboard arm, said axially aligned hole provided in said bottom layer having a diameter which is large enough to pass the shank but not the head of a said fastener for securing said bottom layer to said keyboard arm.

33. A computer keyboard/mouse apparatus as claimed in claim 32 wherein said bottom hole is countersunk to receive said head of a said fastener so that the top surface of the head is flush with the surface of the bottom layer.

34. A method of attaching a keyboard support to a keyboard arm wherein the keyboard support has a top layer and a bottom layer separated by a gap, and at least one pair of axially aligned holes provided in the top and bottom layers with the axis of said holes passing through the gap of the keyboard support, and wherein the axially aligned hole provided in the top layer has a diameter which is large enough to pass the head of a given threaded fastener for securing the bottom layer to a keyboard arm and wherein the axially aligned hole provided in the bottom layer has a diameter which is large enough to pass the shank but not the head of the said given threaded fastener, said method comprising the steps of:

inserting a said given threaded fastener through the axially aligned hole provided in the top layer, through the gap and then into the axially aligned hole of the bottom layer so that the said threaded fastener is in position to secure the keyboard support to the keyboard arm; and, threading the said positioned threaded fastener into the keyboard arm to secure the keyboard support to the keyboard arm.

35. A keyboard support for attachment to a keyboard arm comprising:

a top layer for supporting a keyboard and a bottom layer for attachment to a keyboard arm, said layers being separated by a gap and defining at least one pair of axially aligned holes with the axis of said holes passing through the gap, said axially aligned hole of the top layer having a diameter which is large enough to pass the head of a given threaded fastener for securing the bottom layer to a keyboard arm and said axially aligned hole of the bottom layer having a diameter which is large enough to pass the shank but not the head of the said given threaded fastener.

36. A computer keyboard/mouse apparatus comprising:

a keyboard support having a generally rectangular shape so as to define a front edge, a rear edge and right and left side edges; and, first and second mouse extensions pivotally attached to said keyboard support for pivoting between an extended usable position in which a substantial portion of each said mouse extension is exposed and capable of being used as a mouse extension and a retracted stored position, each said first and second mouse extensions also having a front edge, said first mouse extension being pivotally attached to said keyboard support so that when said first mouse extension is pivoted to its extended usable position a substantial portion of said first mouse extension is located to the right of said right side edge of said keyboard support, said second mouse extension being pivotally attached to said keyboard support so that when said second mouse extension is pivoted to its extended usable position a substantial portion of said second mouse extension is located to the left of said left side edge of said keyboard support, said front edges of said keyboard support and said first and second mouse extensions also being flush with each other so as to define a curved edge when said mouse extensions are in their extended usable positions.

37. A computer keyboard/mouse apparatus as claimed in claim 36 wherein said curved edge defined by said flush front edges of said keyboard support and said mouse extensions has a predetermined radius of curvature.

* * * * *